US011367409B2

(12) United States Patent
Huang

(10) Patent No.: US 11,367,409 B2
(45) Date of Patent: Jun. 21, 2022

(54) LIQUID CRYSTAL DRIVING CIRCUIT AND METHOD SOLVING INSUFFICIENT CHARGING TIME OF TARGET VOLTAGE APPLIED TO PIXEL ELECTRODE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Xiaoyu Huang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/262,757

(22) PCT Filed: Dec. 24, 2018

(86) PCT No.: PCT/CN2018/123180
§ 371 (c)(1),
(2) Date: Jan. 25, 2021

(87) PCT Pub. No.: WO2020/019657
PCT Pub. Date: Jan. 30, 2020

(65) Prior Publication Data

US 2021/0312880 A1 Oct. 7, 2021

(30) Foreign Application Priority Data

Jul. 26, 2018 (CN) ..... 201810836142.X

(51) Int. Cl.
*G09G 3/36* (2006.01)

(52) U.S. Cl.
CPC ..... *G09G 3/3696* (2013.01); *G09G 3/3688* (2013.01)

(58) Field of Classification Search
CPC ..... G09G 3/36; G09G 3/3611; G09G 3/3614; G09G 3/3622; G09G 3/3625; G09G 3/364;
(Continued)

(56) References Cited

U.S. PATENT DOCUMENTS 8,378,930 B2 2/2013 Asano
2005/0024317 A1* 2/2005 Sano ..... G09G 3/3648 345/100
(Continued)

FOREIGN PATENT DOCUMENTS

CN 102436102 A 5/2012
CN 102566177 A 7/2012
(Continued)

*Primary Examiner* — Alexander Eisen
*Assistant Examiner* — Nelson Lam
(74) *Attorney, Agent, or Firm* — Bayramoglu Law Offices LLC

(57) ABSTRACT

A driving apparatus, a display apparatus, and a driving method are provided. The driving apparatus includes: a first switch tube, a second switch tube, a third switch tube, and a data output assembly. A first shared voltage or a second shared voltage are controlled by on states and off states of the first switch tube, the second switch tube, and the third switch tube to be output to a pixel electrode.

5 Claims, 7 Drawing Sheets

(58) Field of Classification Search
CPC .. G09G 3/3644; G09G 3/3648; G09G 3/3688; G09G 3/3692; G09G 3/3696
USPC ..... 345/87–104
See application file for complete search history.

(56) References Cited

U.S. PATENT DOCUMENTS

2008/0048957 A1* 2/2008 Chiang ..... G09G 3/3607 345/87
2011/0037913 A1* 2/2011 Kim ..... G09G 3/3659 349/37
2012/0176354 A1* 7/2012 Katsuta ..... G09G 3/3648 345/204
2012/0235979 A1* 9/2012 Shibazaki ..... G09G 3/3648 345/212
2012/0287028 A1* 11/2012 Katsuta ..... G02F 1/13624 345/88
2013/0128166 A1* 5/2013 Chiang ..... G09G 3/3659 349/38
2013/0215003 A1* 8/2013 Do ..... G09G 3/3659 345/92
2013/0335393 A1* 12/2013 Wang ..... G09G 3/3648 345/212
2015/0022510 A1* 1/2015 Yao ..... G09G 3/3659 345/211
2015/0179114 A1* 6/2015 Dong ..... G09G 3/3648 345/88
2015/0279298 A1* 10/2015 Lin ..... G09G 3/3659 345/100
2016/0071450 A1* 3/2016 Huang ..... G09G 3/3659 345/694
2016/0071473 A1* 3/2016 Ahn ..... G09G 3/3607 345/88
2016/0171948 A1* 6/2016 Chen ..... G09G 3/3696 345/212

FOREIGN PATENT DOCUMENTS

CN 104345513 A 2/2015
CN 109036305 A 12/2018

* cited by examiner

LIQUID CRYSTAL DRIVING CIRCUIT AND METHOD SOLVING INSUFFICIENT CHARGING TIME OF TARGET VOLTAGE APPLIED TO PIXEL ELECTRODE

CROSS REFERENCE TO THE RELATED APPLICATIONS

This application is the national stage entry of International Application No. PCT/CN2018/123180, filed on Dec. 24, 2018, which is based upon and claims priority to Chinese Patent Application No. 201810836142.X, filed on Jul. 26, 2018, the entire contents of which are incorporated herein by reference.

TECHNICAL FIELD

The present application relates to the field of display, and more particularly to a driving circuit and a driving method.

BACKGROUND

The statements here only provide background information related to this application, and do not necessarily constitute prior art. A thin film transistor liquid crystal display (TFT-LCD) is one of the main types of current flat panel displays, and has become an important display platform in modern IT and video products. The main driving principle of the thin film transistor display device is as follows: a system main board is connected to a connector of a printed circuit board (PCB) via wires for transmitting a R/G/B compression signal, a control signal, and a power, after being processed by a timing controller on the PCB, such data are transmitted from the PCB to a display region through a source-chip on film and a gate-chip on film, enabling the display apparatus to obtain required power and signals.

Due to the material properties of liquid crystals in the TFT-LCD, the same voltage applied to the liquid crystals for a long period will cause the liquid crystals to be polarized and cause abnormal display. Therefore, a reference voltage exists in the display of TFT-LCD, a voltage value range higher than the reference voltage is defined as positive polarity, and a voltage value range lower than the reference voltage is defined as negative polarity. During the display process, every frame of the voltage applied to the liquid crystals is switched from positive polarity to negative polarity to avoid polarization of the liquid crystal. However, in actual applications, due to insufficient charging time, the voltage applied on the pixel electrode is directly switched from the positive polarity to the negative polarity, resulting in a relatively large voltage span, and it is difficult to switch the voltage applied on the pixel electrode to a target voltage within a limited charging time, resulting in insufficient charging. In such condition, charge sharing technology is desired, which includes: before the pixel electrode starts charging, the charge applied on the pixel electrode is firstly neutralized to near the reference voltage, and then continues to be charged from the reference voltage to the target voltage. In the prior art, this function is realized through the built-in logic module in the S-COF.

SUMMARY

It is an objective of the present application to provide a driving circuit, which aims at solving the technical problems including but not limited to that due to insufficient charging time, the voltage applied on the pixel electrode is directly switched from the positive polarity to the negative polarity, resulting in a relatively large voltage span, and it is difficult to switch the voltage applied on the pixel electrode to a target voltage within a limited charging time, resulting in insufficient charging.

Technical solutions adopted by embodiments of the present application are as follows: A driving circuit for a display panel is provided. The driving circuit comprises: a first switch tube, with a control terminal of the first witch being coupled to a first control signal, and a first terminal of the first switch tube being coupled to a first shared voltage; a second switch tube, with a control terminal of the second switch tube being coupled to the first control signal, and a first terminal of second switch tube being coupled to a second shared voltage; a third switch tube, with a control terminal of the third switch tube being coupled to a second control signal, a first terminal of the third switch tube being coupled to a second terminal of the first switch tube and a second terminal of the second switch tube, and a second terminal of the third switch tube being coupled to a pixel electrode; and a data output assembly, with the data output assembly being coupled to the pixel electrode. On states and off states of the first switch tube, the second switch tube, and the third switch tube are controlled by output voltages of the first control signal and the second control signal. The first shared voltage or the second shared voltage are controlled by the on states and the off states of the first switch tube, the second switch tube, and the third switch tube to be output to the pixel electrode.

In an embodiment of the present application, the first switch tube is a P-type field effect transistor, and the second switch tube and the third switch tube are N-type field effect transistors.

In an embodiment of the present application, the first shared voltage is a positive shared voltage, and the second shared voltage is a negative shared voltage.

In an embodiment of the present application, the first shared voltage is a lowest voltage required for neutralizing a negative voltage of the pixel electrode to positive polarity display; and the second shared voltage is a lowest voltage required for neutralizing a positive voltage of the pixel electrode to negative polarity display.

In an embodiment of the present application, when a display picture is switched from a negative polarity signal to a positive polarity signal, potential switching of the first control signal and the second control signal is carried out as follows: in a first period, the first control signal is at a low potential, and the second control signal is at a high potential; and in a second period, the first control signal is at a low potential, and the second control signal is at a low potential.

In an embodiment of the present application, in the first period, the first switch tube and the third switch tube are turned on, and the second switch tube is turned off, and the first shared voltage is output to the pixel electrode via the first switch tube and the third switch tube, and neutralizes charges in the pixel electrode.

In an embodiment of the present application, in the second period, the third switch tube is turned off, and display data is output from the data output assembly to the pixel electrode.

In an embodiment of the present application, when the display picture is switched from the positive polarity signal to the negative polarity signal, the potential switching of the first control signal and the second control signal is carried out as follows: in the first period, the first control signal is at a high potential, and the second control signal is at a high potential; and in the second period, the first control signal is at the high potential, and the second control signal is at a low potential.

In an embodiment of the present application, in the first period, the second switch tube and the third switch tube are turned on, and the first switch tube is turned off, and the second shared voltage is output to the pixel electrode via the second switch tube and the third switch tube, and neutralizes charges in the pixel electrode.

In an embodiment of the present application, in the second period, the third switch tube is turned off, and display data is output by the data output assembly to the pixel electrode.

It is another objective of the present application to provide a display apparatus, which comprises: a first switch tube, with a control terminal of the first witch being coupled to a first control signal, and a first terminal of the first switch tube being coupled to a first shared voltage; a second switch tube, with a control terminal of the second switch tube being coupled to the first control signal, and a first terminal of second switch tube being coupled to a second shared voltage; a third switch tube, with a control terminal of the third switch tube being coupled to a second control signal, a first terminal of the third switch tube being coupled to a second terminal of the first switch tube and a second terminal of the second switch tube, and a second terminal of the third switch tube being coupled to a pixel electrode; and a data output assembly, with the data output assembly being coupled to the pixel electrode. On states and off states of the first switch tube, the second switch tube, and the third switch tube are controlled by output voltages of the first control signal and the second control signal. The first shared voltage or the second shared voltage are controlled by the on states and the off states of the first switch tube, the second switch tube, and the third switch tube to be output to the pixel electrode.

It is still another objective of the present application to provide a driving method, which comprises: providing a first switch tube, where a control terminal of the first witch is coupled to a first control signal, and a first terminal of the first switch tube is coupled to a first shared voltage; providing a second switch tube, where a control terminal of the second switch tube is coupled to the first control signal, and a first terminal of second switch tube is coupled to a second shared voltage; providing a third switch tube, where a control terminal of the third switch tube is coupled to a second control signal, a first terminal of the third switch tube is coupled to a second terminal of the first switch tube and a second terminal of the second switch tube, and a second terminal of the third switch tube is coupled to a pixel electrode; and providing a data output assembly, where the data output assembly is coupled to the pixel electrode. On states and off states of the first switch tube, the second switch tube, and the third switch tube are controlled by output voltages of the first control signal and the second control signal. The first shared voltage or the second shared voltage are controlled by the on states and the off states of the first switch tube, the second switch tube, and the third switch tube to be output to the pixel electrode.

In an embodiment of the present application, the driving method further comprises:

acquiring the first shared voltage, where the first shared voltage is a lowest voltage required for neutralizing a negative voltage of the pixel electrode to positive polarity display; and acquiring the second shared voltage, where the second shared voltage is a lowest voltage required for neutralizing a positive voltage of the pixel electrode to negative polarity display.

In an embodiment of the present application, the first switch tube is a P-type field effect transistor, and the second switch tube and the third switch tube are N-type field effect transistors.

In an embodiment of the present application, the first shared voltage is a positive shared voltage, and the second shared voltage is a negative shared voltage.

In an embodiment of the present application, when a display picture is switched from a negative polarity signal to a positive polarity signal, potential switching of the first control signal and the second control signal is carried out as follows:

in a first period, the first control signal is at a low potential, and the second control signal is at a high potential; and in a second period, the first control signal is at a low potential, and the second control signal is at a low potential.

In an embodiment of the present application, in the first period, the first switch tube and the third switch tube are turned on, and the second switch tube is turned off, and the first shared voltage is output to the pixel electrode via the first switch tube and the third switch tube, and neutralizes charges in the pixel electrode.

In an embodiment of the present application, in the second period, the third switch tube is turned off, and display data is output from the data output assembly to the pixel electrode.

In an embodiment of the present application, when the display picture is switched from the positive polarity signal to the negative polarity signal, the potential switching of the first control signal and the second control signal is carried out as follows:

in the first period, the first control signal is at a high potential, and the second control signal is at a high potential; and in the second period, the first control signal is at the high potential, and the second control signal is at a low potential.

In embodiments of the present application, multiple active switch tubes are provided, and the high and low potentials of the first control signal and the second control signal are utilized to control the on states and off states of the multiple active switch tubes. In this way, positive voltage or negative voltage can be selectively applied to the pixel electrode to neutralize the charges of different polarity in the pixel electrode and to adjust the voltage of the pixel electrode to be within the reference voltage range, thereby realizing charge sharing and improving the display effect of the display panel.

BRIEF DESCRIPTION OF THE DRAWINGS

In order to more clearly illustrate the technical solutions in the embodiments of the present application, the drawings that need to be used in the description of the embodiments or the exemplary art will be briefly described hereinbelow. Obviously, the accompanying drawings in the following description are only some embodiments of the present application. For those skilled in the art, other drawings can be obtained based on these drawings without creative work.

DETAILED DESCRIPTION OF THE EMBODIMENTS

Figure 1:
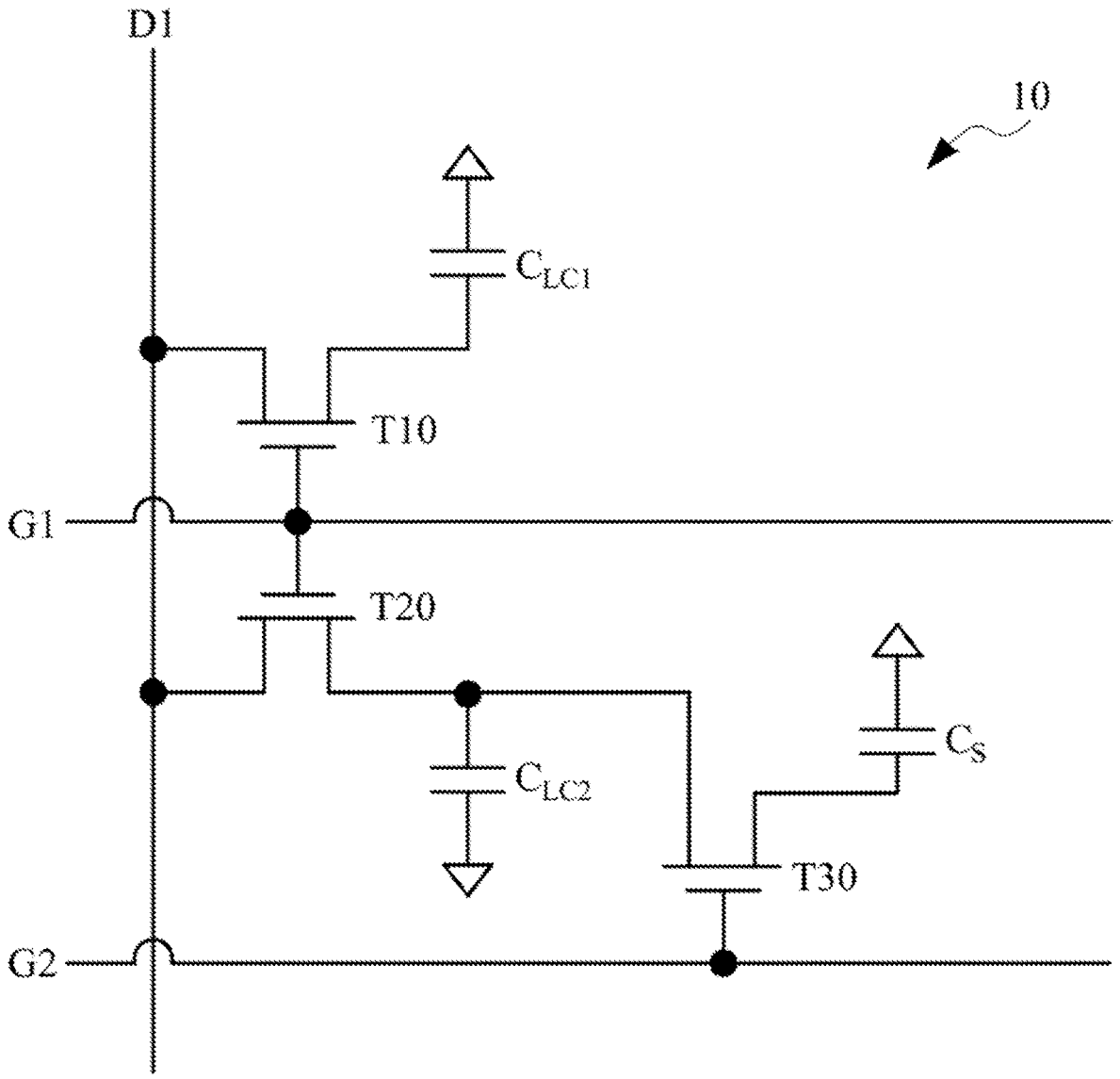
FIG. 1 is a partial schematic diagram of an exemplary driving circuit.

In order to make the purpose, technical solutions, and advantages of the present application clearer, the present application will be further described in details in combination with the accompanying drawings and embodiments. It should be understood that the specific embodiments described here are only used to explain the present application, and are not used to limit the present application.

It should be noted that when a component is said to be "fixed on" or "installed on" another component, it can be directly or indirectly on the other component. When a component is said to be "connected" to another component, it can be directly or indirectly connected to the other component. The terms "upper", "lower", "left", "right", etc. indicate the orientation or positional relationship based on the orientation or positional relationship shown in the drawings, and are only for ease of description, and do not indicate or imply the device referred to or the element must have a specific orientation, and be constructed and operated in a specific orientation, and therefore cannot be construed as a limitation of the present application. For those skilled in the art, the specific meaning of the above terms can be understood according to specific conditions. The terms "first" and "second" are only used for ease of description, and cannot be understood as indicating or implying relative importance or implicitly indicating the number of technical features. The meaning of "plurality" means two or more than two, unless otherwise specifically defined.

In order to further explain the technical means and effects adopted by the present application to achieve the intended purposes, a driving circuit provided by the present application is described in detail hereinbelow in its specific implementation, structure, features, and effects, combining with the drawings and specific embodiments, FIG. 1 is a partial schematic diagram of an exemplary driving circuit. Referring to FIG. 1, an exemplary driving circuit 10 includes: a charge switch tube T10, a liquid crystal capacitor $C_{LC1}$, a charge switch tube T20, a liquid crystal capacitor $C_{LC2}$, a discharge switch tube T30, and a storage capacitor $C_S$. During a first frame period, a scanning signal is sent from the scanning line G1 to turn on the charge circuit T10 and the charge circuit T20. In such condition, a display voltage of a data line (data line) D1 (for example, positive polarity) will charge the liquid crystal capacitor $C_{LC1}$ and the liquid crystal capacitor $C_{LC2}$. Then, when another scanning signal is sent from a next scanning line G2, the discharge switch tube T30 will be turned on, and in such condition, charges in the liquid crystal capacitor $C_{LC2}$ will be shared with the storage capacitor $C_S$, making voltages of the liquid crystal capacitor $C_{LC2}$ and the storage capacitor $C_S$ balanced. During a second frame period, another scanning signal is sent from the scanning line G1 to turn on the charge circuit T10 and the charge circuit T20 again. In such condition, the display voltage (for example, negative polarity) of the data line D1 makes the liquid crystal capacitor $C_{LC1}$ and the liquid crystal capacitor $C_{LC2}$ discharge, the liquid crystal capacitor $C_{LC1}$ and the liquid crystal capacitor $C_{LC2}$ will reach the same negative voltage as the data line D1; then, when another scanning signal is sent from the next scanning line G2, the discharge switch tube T30 will be turned on. In such condition, the positive polarity charge stored in the storage capacitor $C_S$ at the first frame period neutralizes the negative polarity charge in the liquid crystal capacitor $C_{LC2}$. Therefore, the liquid crystal capacitor $C_{LC1}$ and the liquid crystal capacitor $C_{LC2}$ have different voltages.

Figure 2:
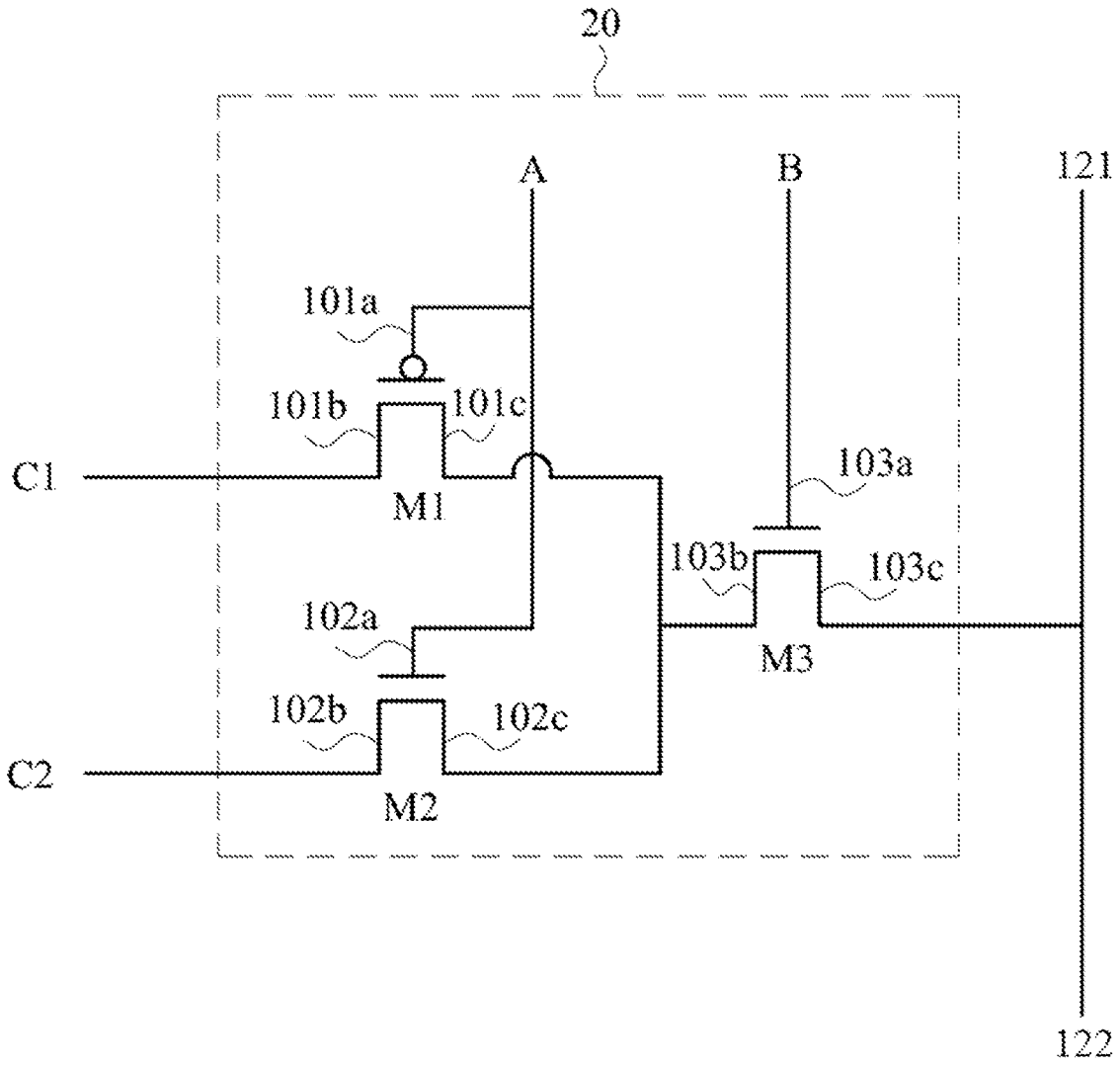
FIG. 2 is a schematic diagram of a driving circuit provided by an embodiment of the present application.
Figure 3:
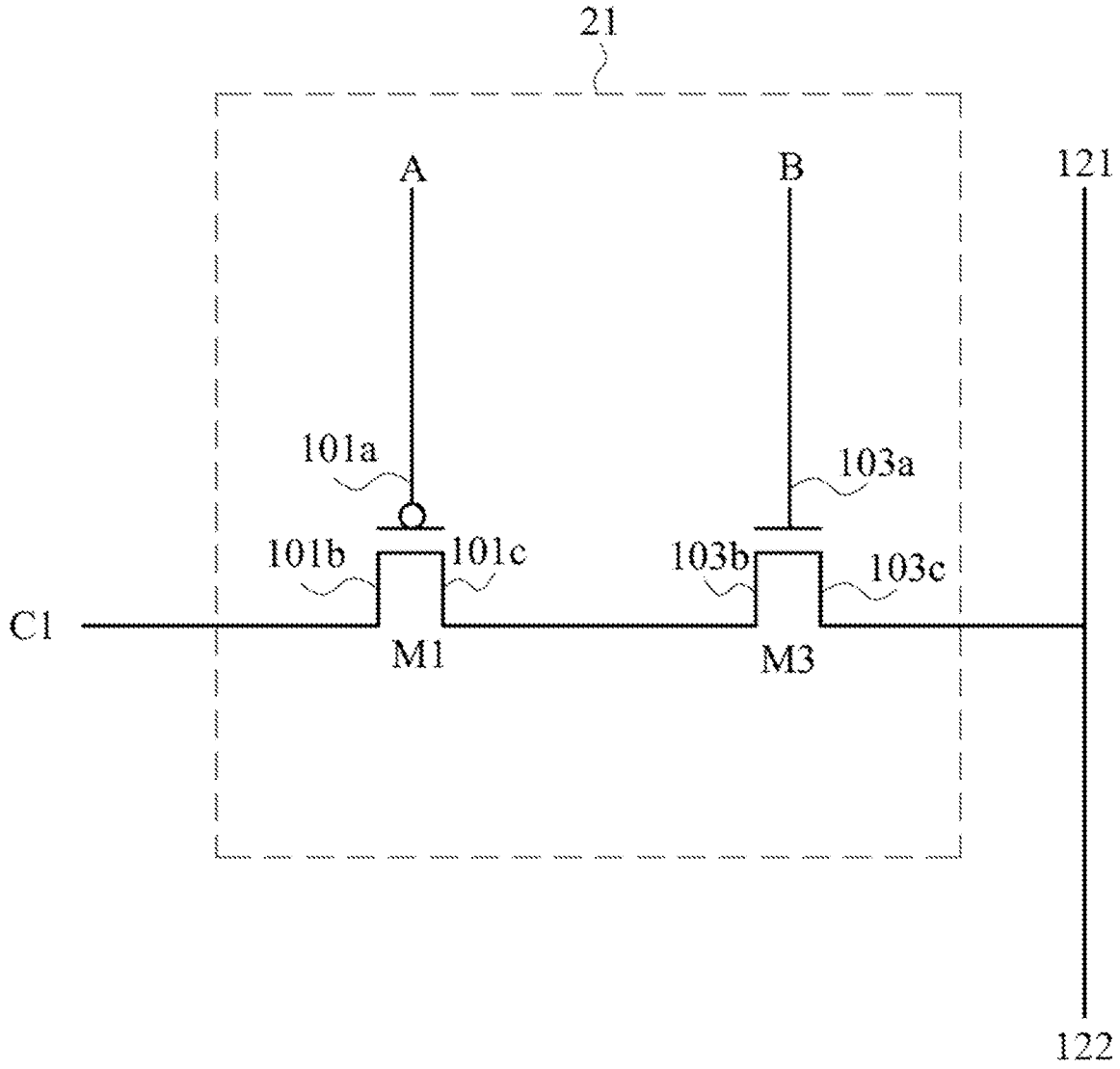
FIG. 3 is a schematic diagram of an equivalent circuit at a first period provided by an embodiment of the present application.
Figure 4:
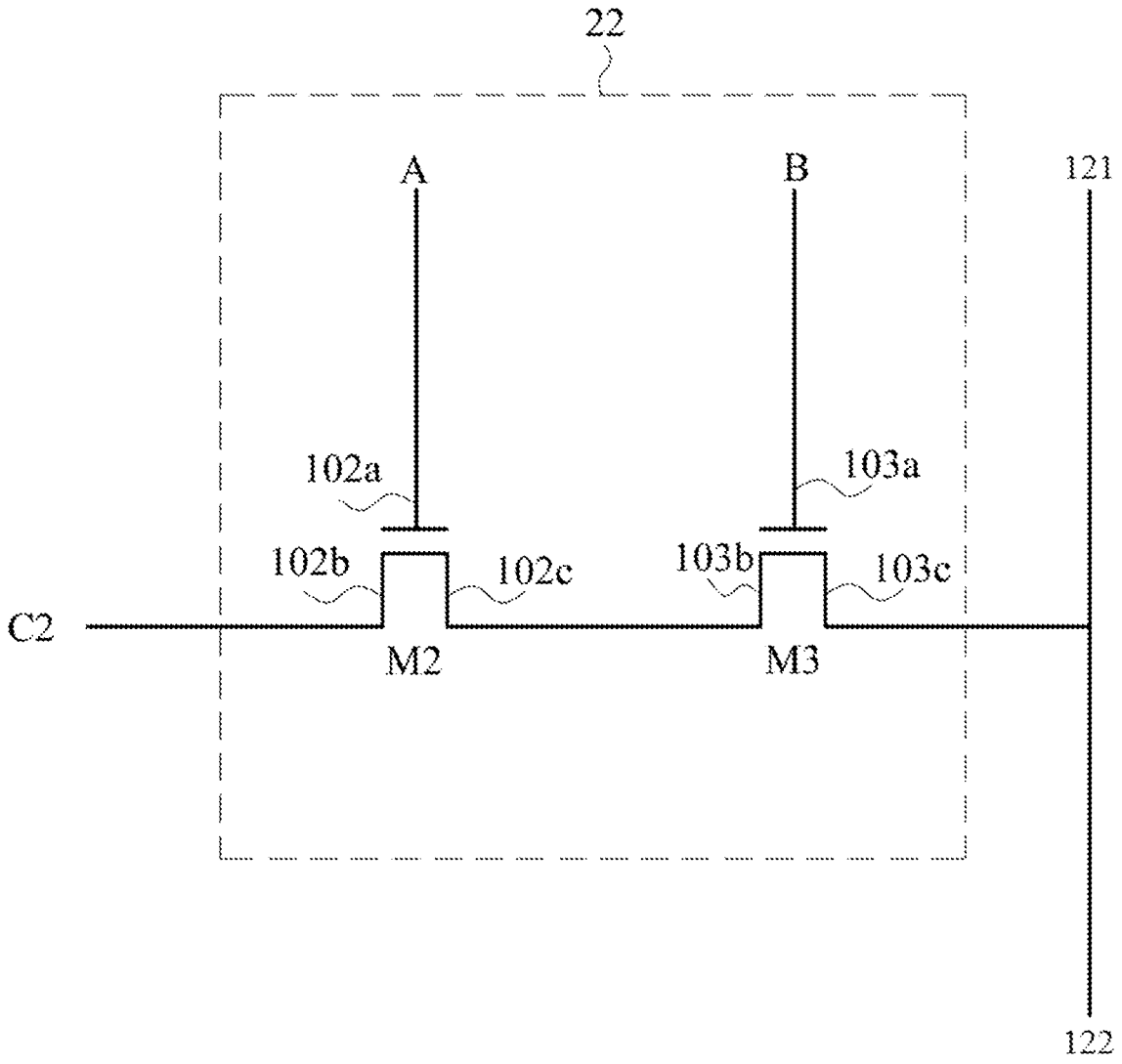
FIG. 4 is a schematic diagram of an equivalent circuit at a first period provided by an embodiment of the present application.

FIG. 2 is a schematic diagram of a driving circuit provided by an embodiment of the present application, and FIGS. 3-4 are schematic diagrams of equivalent circuits at a first period provided an embodiment of the present application. Referring to FIGS. 2-4, in an embodiment of the present application, a driving circuit 20, comprises: a first switch tube M1, with a control terminal 101*a* of the first witch M1 being coupled to a first control signal A, and a first terminal 101*b* of the first switch tube M1 being coupled to a first shared voltage C1; a second switch tube M2, with a control terminal 102*a* of the second switch tube M2 being coupled to the first control signal A, and a first terminal 102*b* of second switch tube M2 being coupled to a second shared voltage C2; a third switch tube M3, with a control terminal 103*a* of the third switch tube M3 being coupled to a second control signal B, a first terminal 103*b* of the third switch tube M3 being coupled to a second terminal 101*c* of the first switch tube M1 and a second terminal 101*c* of the second switch tube M2, and a second terminal 103*c* of the third switch tube M3 being coupled to a pixel electrode 122; and a data output assembly 121, with the data output assembly 121 being coupled to the pixel electrode 122; where on states and off states of the first switch tube M1, the second switch tube M2, and the third switch tube M3 are controlled by output voltages of the first control signal A and the second control signal B.

In an embodiment of the present application, the first shared voltage C1 or the second shared voltage C2 are controlled by the on states and the off states of the first switch tube M1, the second switch tube M2, and the third switch tube M3 to be output to the pixel electrode 122.

In an embodiment of the present application, the first switch tube M1 is a P-type field effect transistor, and the second switch tube M2 and the third switch tube M3 are N-type field effect transistors.

In an embodiment of the present application, the first shared voltage C1 is a positive shared voltage, and the second shared voltage C2 is a negative shared voltage.

In an embodiment of the present application, when a display picture is switched from a negative polarity signal to a positive polarity signal, potential switching of the first control signal A and the second control signal B is carried out as follows: in a first period, the first control signal A is at a low potential L, and the second control signal B is at a high potential H; and in a second period, the first control signal A remains at an original potential, that is, the low potential L, and the second control signal is switched to a low potential L.

In an embodiment of the present application, in the first period, the first switch tube M1 and the third switch tube M3 are turned on, and the second switch tube M2 is turned off, the equivalent circuit is shown as the circuit 21 of FIG. 3, in which, the first shared voltage C1 is output to the pixel electrode 122 via the first switch tube M1 and the third switch tube M3, and neutralizes negative charges in the pixel electrode 122, so that the voltage of the pixel electrode 122 is adjusted to be within a reference voltage range.

In an embodiment of the present application, in the second period, the third switch tube M3 is turned off, and display data is output from the data output assembly 121 to the pixel electrode 122.

In an embodiment of the present application, when the display picture is switched from the positive polarity signal to the negative polarity signal, the potential switching of the first control signal A and the second control signal B is carried out as follows: in the first period, the first control signal A is at a high potential H, and the second control signal B is at a high potential H; and in the second period, the first control signal A remains at an original potential, that is, the high potential H, and the second control signal is at a low potential L.

In an embodiment of the present application, in the first period, the first switch tube M1 is turned off, and the second switch tube M2 and the third switch tube M3 are turned on, the equivalent circuit is shown as the circuit 22 of FIG. 4, in which, the second shared voltage C2 is output to the pixel electrode 122 via the second switch tube M2 and the third switch tube M3, and neutralizes positive charges in the pixel electrode 122, so that the voltage of the pixel electrode 122 is adjusted to be within the reference voltage range.

In an embodiment of the present application, in the second period, the third switch tube M3 is turned off, and display data is output by the data output assembly 121 to the pixel electrode 122.

Figure 5:
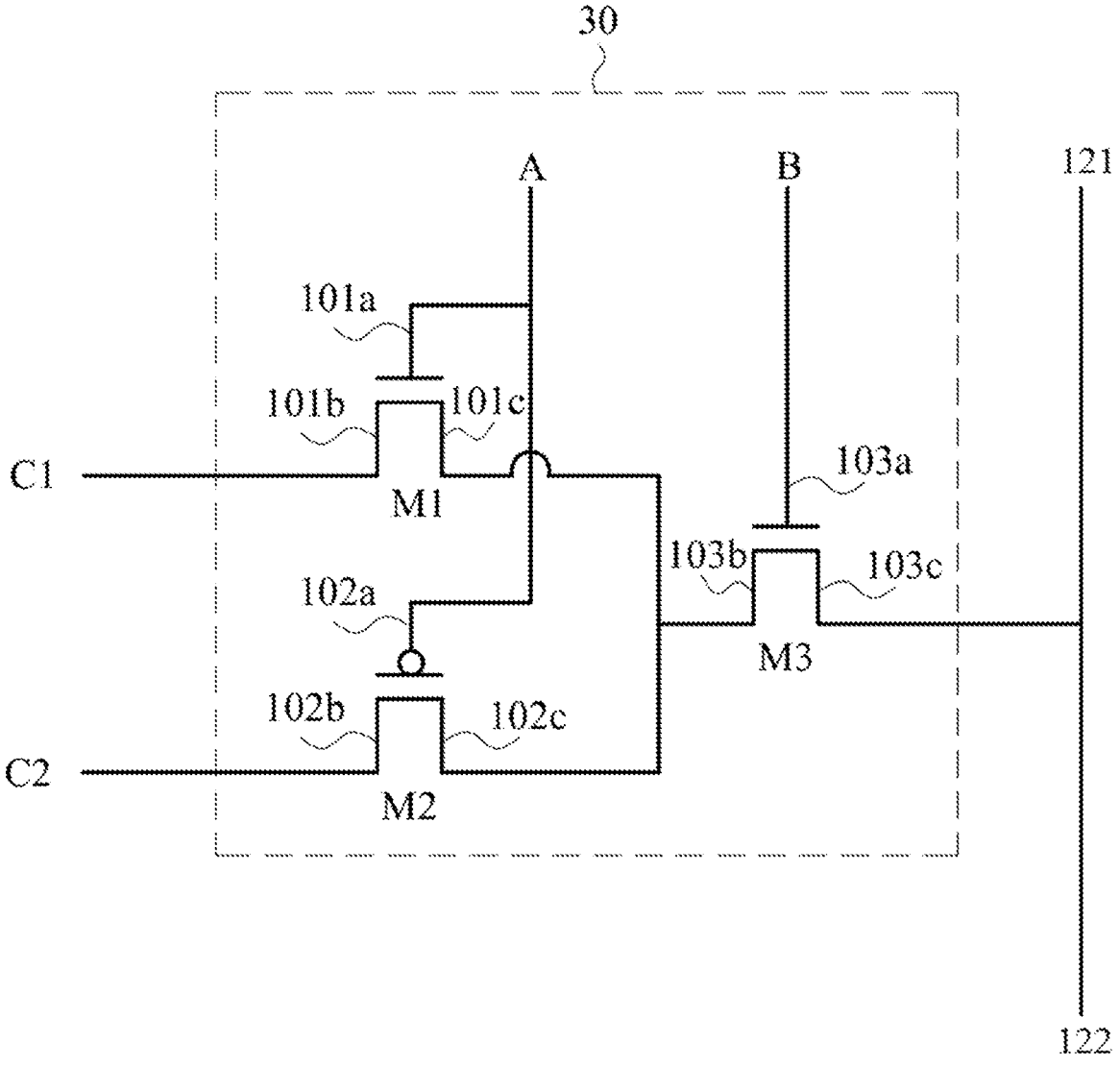
FIG. 5 is a schematic diagram of a driving circuit provided by another embodiment of the present application.

FIG. 5 is a schematic diagram of a driving circuit provided by another embodiment of the application. In an embodiment of the present application, a driving circuit 30 is the same as the above-described driving circuit 20 except that: the first switch tube M1 and the third switch tube M3 are N-type field effect transistors, and the second switch tube M2 is a P-type field effect transistor. By switching the high and low potentials of the first control signal A and the second control signal B, eliminating charges of different polarities on the pixel electrode 122 can also be equivalently achieved.

Figure 6:
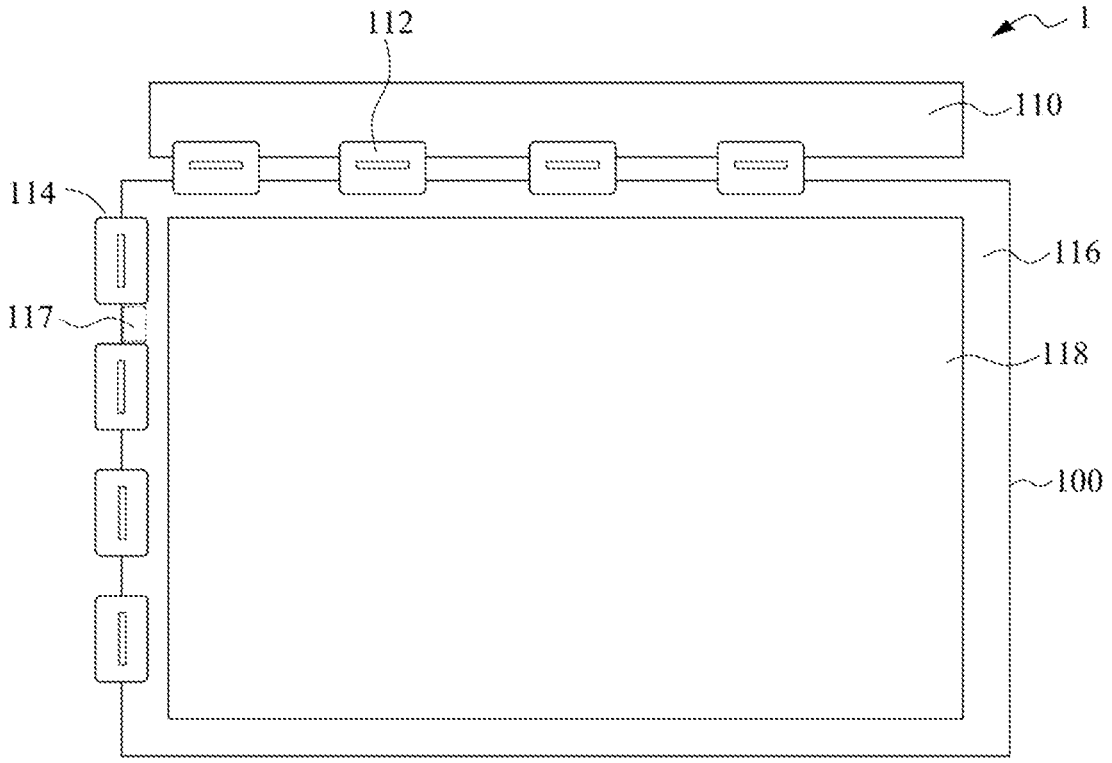
FIG. 6 is a display apparatus provided by an embodiment of the present application.

FIG. 6 is a schematic diagram of a display panel provided by an embodiment of the present application. In an embodiment of the present application, a display apparatus 1 comprises: a controller part 110; a display panel 100, with the display panel 100 having a display region 118 and a non-display region 116; and a plurality of source driving chips 112 and a plurality of gate driving chips 114, both of which are oppositely arranged at the non-display region 116. The driving circuits 20, 30 as described in the above embodiments can be, for example, arranged at the non-display region 116 of the display panel, and can also be arranged at a fanout area 117 of the display panel.

Figure 7:
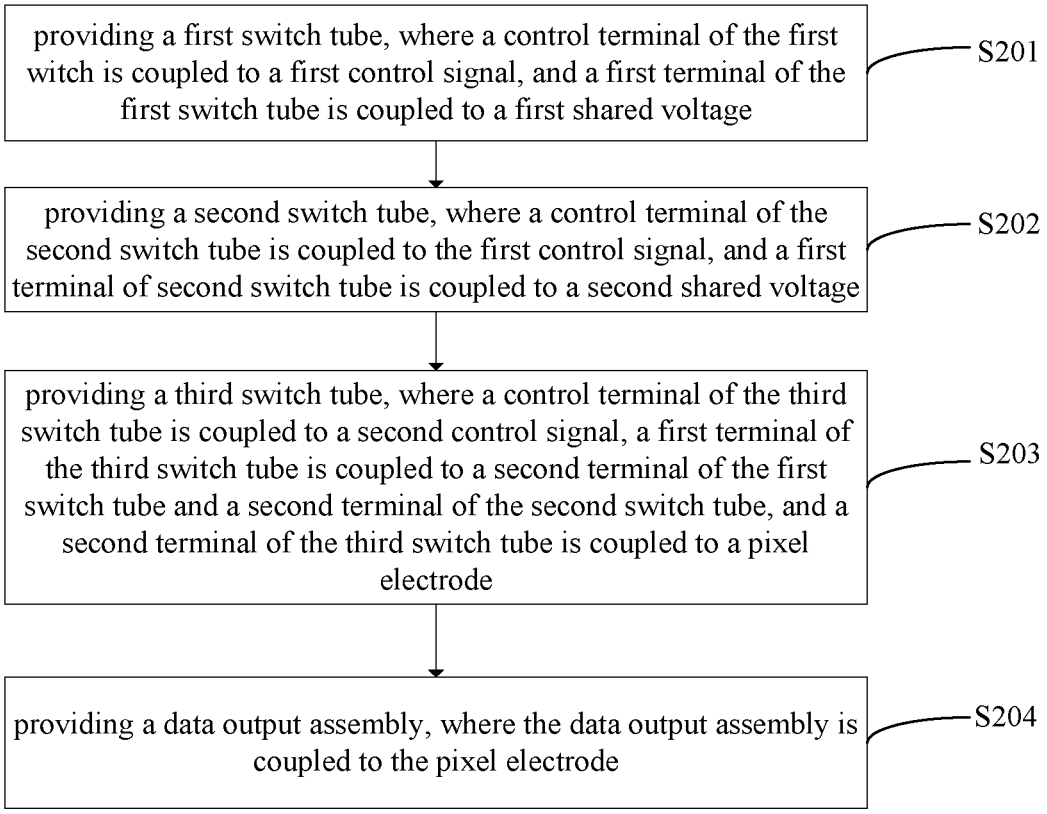
FIG. 7 is a flow chart of a driving method provided by an embodiment of the present application.

FIG. 7 is a flow chart of a driving method provided by an embodiment of the present application. As shown in FIG. 7 and FIG. 2, in an embodiment of the present application, a driving method comprises:

S201, providing a first switch tube M1, with a control terminal 101*a* of the first witch M1 being coupled to a first control signal A, and a first terminal 101*b* of the first switch tube M1 being coupled to a first shared voltage C1;

S202, providing a second switch tube M2, with a control terminal 102*a* of the second switch tube M2 being coupled to the first control signal A, and a first terminal 102*b* of second switch tube M2 being coupled to a second shared voltage C2;

S203, providing a third switch tube M3, with a control terminal 103*a* of the third switch tube M3 being coupled to a second control signal B, a first terminal 103*b* of the third switch tube M3 being coupled to a second terminal 101*c* of the first switch tube M1 and a second terminal 101*c* of the second switch tube M2, and a second terminal 103*c* of the third switch tube M3 being coupled to a pixel electrode 122; and S204, providing a data output assembly 121, with the data output assembly 121 being coupled to the pixel electrode 122.

On states and off states of the first switch tube M1, the second switch tube M2, and the third switch tube M3 are controlled by output voltages of the first control signal A and the second control signal B.

The first shared voltage C1 or the second shared voltage C2 are controlled by the on states and the off states of the first switch tube M1, the second switch tube M2, and the third switch tube M3 to be output to the pixel electrode 122.

In an embodiment of the present application, the driving method further comprises:

acquiring the first shared voltage C1, where the first shared voltage C1 is a lowest voltage required for neutralizing a negative voltage of the pixel electrode 122 to positive polarity display; and acquiring the second shared voltage C2, where the second shared voltage C2 is a lowest voltage required for neutralizing a positive voltage of the pixel electrode 122 to negative polarity display.

In an embodiment of the present application, the first switch tube M1 is a P-type field effect transistor, and the second switch tube M2 and the third switch tube M3 are N-type field effect transistors.

In an embodiment of the present application, the first shared voltage C1 is a positive shared voltage, and the second shared voltage C2 is a negative shared voltage.

In an embodiment of the present application, an operation of potential switching of the first control signal A and the second control signal B when a display picture is switched from a negative polarity signal to a positive polarity signal is carried out as follows:

in a first period, the first control signal A is at a low potential L, and the second control signal B is at a high potential H; and in a second period, the first control signal A is at the low potential L, and the second control signal is at a low potential L.

In an embodiment of the present application, in the first period, the first switch tube M1 and the third switch tube M3 are turned on, and the second switch tube M2 is turned off. The first shared voltage C1 is output to the pixel electrode 122 via the first switch tube M1 and the third switch tube M3, and neutralizes charges in the pixel electrode 122, In an embodiment of the present application, in the second period, the third switch tube M3 is turned off, and display data is output from the data output assembly 121 to the pixel electrode 122.

In an embodiment of the present application, an operation of potential switching of the first control signal A and the second control signal B when the display picture is switched from the positive polarity signal to the negative polarity signal, is carried out as follows:

in the first period, the first control signal A is at a high potential H, and the second control signal B is at a high potential H; and in the second period, the first control signal A is at the high potential H, and the second control signal is at a low potential L.

In the present application, multiple active switch tubes (M1, M2, M3) are provided, and the high and low potentials of the first control signal A and the second control signal B are utilized to control the on states and off states of the multiple active switch tubes. In this way, positive voltage or negative voltage can be selectively applied to the pixel electrode 122 to neutralize the charges of different polarity in the pixel electrode 122 and to adjust the voltage of the pixel electrode 122 to be within the reference voltage range, thereby realizing charge sharing and improving the display effect of the display panel.

The terms "in some embodiments" and "in various embodiments" are used repeatedly. The term generally does not refer to the same embodiment; but it can also refer to the same embodiment. The terms "comprising", "having" and "including" are synonymous, unless otherwise indicated in the context.

The above are only optional embodiments of the application, and are not used to limit the application. Although the specific embodiments of the present application are disclosed as in the above, they are not intended to limit the present application. Without departing from the scope of the technical solution of the present application, those skilled in the art would make changes or modifications to acquire equivalent embodiments under the teaching of above-described technical contents. However, without departing from the content of the technical solution of the present application, any modification, equivalent replacement, improvement, etc. made according to the technical essence of the present application shall be included in the scope of the claims of present application.

What is claimed is:

1. A driving circuit for a display panel, comprising:

a first switch tube, wherein a control terminal of the first switch tube is coupled to a first control signal, and a first terminal of the first switch tube is coupled to a first shared voltage;

a second switch tube, wherein a control terminal of the second switch tube is coupled to the first control signal, and a first terminal of the second switch tube is coupled to a second shared voltage;

a third switch tube, wherein a control terminal of the third switch tube is coupled to a second control signal, a first terminal of the third switch tube is coupled to a second terminal of the first switch tube and a second terminal of the second switch tube, and a second terminal of the third switch tube is coupled to a pixel electrode; and a data output assembly, wherein the data output assembly is coupled to the pixel electrode;

wherein, on states and off states of the first switch tube, the second switch tube, and the third switch tube are controlled by output voltages of the first control signal and the second control signal;

the first shared voltage or the second shared voltage is controlled by the on states and the off states of the first switch tube, the second switch tube, and the third switch tube to be output to the pixel electrode;

the first switch tube is a P-type field effect transistor, and the second switch tube and the third switch tube are N-type field effect transistors;

the first shared voltage is a lowest voltage required for neutralizing a negative voltage of the pixel electrode to positive polarity display; and the second shared voltage is a lowest voltage required for neutralizing a positive voltage of the pixel electrode to negative polarity display; and when a display picture is switched from a negative polarity signal to a positive polarity signal, or switched from a positive polarity signal to a negative polarity signal, potential switching of the first control signal and the second control signal comprises a first period and a second period, wherein in the first period, one of the first switch tube and the second switch tube is turned on and the third switch tube is turned on, such that the first shared voltage or the second shared voltage is output to the pixel electrode, and neutralizes charges in the pixel electrode; and in the second period, the third switch tube is turned off, and display data is output from the data output assembly to the pixel electrode.

2. The driving circuit of claim 1, wherein the first shared voltage is a positive shared voltage, and the second shared voltage is a negative shared voltage.

3. A display panel, comprising:

a first switch tube, wherein a control terminal of the first switch tube is coupled to a first control signal, and a first terminal of the first switch tube is coupled to a first shared voltage;

a second switch tube, wherein a control terminal of the second switch tube is coupled to the first control signal, and a first terminal of the second switch tube is coupled to a second shared voltage;

a third switch tube, wherein a control terminal of the third switch tube is coupled to a second control signal, a first terminal of the third switch tube is coupled to a second terminal of the first switch tube and a second terminal of the second switch tube, and a second terminal of the third switch tube is coupled to a pixel electrode; and a data output assembly, wherein the data output assembly is coupled to the pixel electrode;

wherein, on states and off states of the first switch tube, the second switch tube, and the third switch tube are controlled by output voltages of the first control signal and the second control signal;

the first shared voltage or the second shared voltage is controlled by the on states and the off states of the first switch tube, the second switch tube, and the third switch tube to be output to the pixel electrode;

the first switch tube is a P-type field effect transistor, and the second switch tube and the third switch tube are N-type field effect transistors;

the first shared voltage is a lowest voltage required for neutralizing a negative voltage of the pixel electrode to positive polarity display; and the second shared voltage is a lowest voltage required for neutralizing a positive voltage of the pixel electrode to negative polarity display; and when a display picture is switched from a negative polarity signal to a positive polarity signal, or switched from a positive polarity signal to a negative polarity signal, potential switching of the first control signal and the second control signal comprises a first period and a second period, wherein in the first period, one of the first switch tube and the second switch tube is turned on and the third switch tube is turned on, such that the first shared voltage or the second shared voltage is output to the pixel electrode, and neutralizes charges in the pixel electrode; and in the second period, the third switch tube is turned off, and display data is output from the data output assembly to the pixel electrode.

4. A driving method, comprising:

providing a first switch tube, wherein a control terminal of the first switch tube is coupled to a first control signal, and a first terminal of the first switch tube is coupled to a first shared voltage;

providing a second switch tube, wherein a control terminal of the second switch tube is coupled to the first control signal, and a first terminal of the second switch tube is coupled to a second shared voltage;

providing a third switch tube, wherein a control terminal of the third switch tube is coupled to a second control signal, a first terminal of the third switch tube is coupled to a second terminal of the first switch tube and a second terminal of the second switch tube, and a second terminal of the third switch tube is coupled to a pixel electrode; and providing a data output assembly, wherein the data output assembly is coupled to the pixel electrode;

wherein, on states and off states of the first switch tube, the second switch tube, and the third switch tube are controlled by output voltages of the first control signal and the second control signal;

the first shared voltage or the second shared voltage is controlled by the on states and the off states of the first switch tube, the second switch tube, and the third switch tube to be output to the pixel electrode; and the first switch tube is a P-type field effect transistor, and the second switch tube and the third switch tube are N-type field effect transistors;

the method further comprises:

acquiring the first shared voltage, wherein the first shared voltage is a lowest voltage required for neutralizing a negative voltage of the pixel electrode to positive polarity display; and acquiring the second shared voltage, the second shared voltage is a lowest voltage required for neutralizing a positive voltage of the pixel electrode to negative polarity display; and when a display picture is switched from a negative polarity signal to a positive polarity signal, or switched from a positive polarity signal to a negative polarity signal, potential switching of the first control signal and the second control signal comprises a first period and a second period, wherein in the first period, one of the first switch tube and the second switch tube is turned on and the third switch tube is turned on, such that the first shared voltage or the second shared voltage is output to the pixel electrode, and neutralizes charges in the pixel electrode; and in the second period, the third switch tube is turned off, and display data is output from the data output assembly to the pixel electrode.

5. The driving method of claim 4, wherein the first shared voltage is a positive shared voltage, and the second shared voltage is a negative shared voltage.

* * * * *